US007170423B2

(12) United States Patent
Wisler et al.

(10) Patent No.: US 7,170,423 B2
(45) Date of Patent: Jan. 30, 2007

(54) ELECTROMAGNETIC MWD TELEMETRY SYSTEM INCORPORATING A CURRENT SENSING TRANSFORMER

(75) Inventors: MacMillan Wisler, Kingwood, TX (US); Wu Jian-Qun, Houston, TX (US); Denis Weisbeck, Spring, TX (US)

(73) Assignee: Weatherford Canada Partnership, Edmonton (CA)

( * ) Notice: Subject to any disclaimer, the term of this patent is extended or adjusted under 35 U.S.C. 154(b) by 553 days.

(21) Appl. No.: 10/649,432

(22) Filed: Aug. 27, 2003

(65) Prior Publication Data

US 2005/0046588 A1 Mar. 3, 2005

(51) Int. Cl.
*G01V 3/00* (2006.01)

(52) U.S. Cl. ..... 340/853.7; 367/82

(58) Field of Classification Search ..... 340/853.7, 340/853.1, 854.9; 367/82
See application file for complete search history.

(56) References Cited

U.S. PATENT DOCUMENTS

| | | | | |
|---|---|---|---|---|
| 4,684,946 | A | 8/1987 | Issenmann | |
| 5,163,714 | A | 11/1992 | Issenmann | |
| 5,394,141 | A | 2/1995 | Soulier | |
| 5,831,549 | A | 11/1998 | Geachert | |
| 5,945,923 | A | 8/1999 | Soulier | |
| 6,218,959 | B1 * | 4/2001 | Smith | 340/853.7 |
| 6,531,871 | B1 | 3/2003 | Hay et al. | |
| 6,628,206 | B1 | 9/2003 | Soulier | |
| 6,727,827 | B1 * | 4/2004 | Edwards et al. | 340/854.9 |
| 6,781,520 | B1 * | 8/2004 | Smith et al. | 340/853.1 |
| 2003/0010493 | A1 | 1/2003 | Hill et al. | |

FOREIGN PATENT DOCUMENTS

| | | | |
|---|---|---|---|
| EP | 0903591 | A3 | 10/2001 |
| GB | 2 344 896 | A | 6/2000 |
| GB | 2 346 509 | A | 8/2000 |
| WO | WO 01/04461 | A1 | 1/2001 |
| WO | WO 02/12676 | A | 2/2002 |

OTHER PUBLICATIONS

Peter Brett, Denis Weisbeck, Robert Graham; Innovative Technology Advances Use of Electromagnetic MWD Offshore in Southern North Sea; IADC/SPE 81628 Technical Paper. Presented at the IADC/SPE Underbalanced Technology Conference & Exhibition held in Houston, TX, Mar. 25-26, 2003.

UK Patent Office Search Report in Application No. GB 2346509A dated Nov. 2, 2004.

* cited by examiner

*Primary Examiner*—Albert K. Wong
(74) *Attorney, Agent, or Firm*—Patrick H. McCollom

(57) ABSTRACT

An electromagnetic telemetry system for transmitting data from a downhole assembly, which is operationally attached to a drill string, to a telemetry receiver system. The data are typically responses of one or more sensors disposed within the downhole assembly. A downhole transmitter induces a signal current within the drill string. The signal current is modulated to represent the transmitted data. Induced signal current is measured directly with the telemetry receiver system. The telemetry receiver system includes a transformer that surrounds the path of the current, and an electromagnetic current receiver. The transformer preferably comprises a toroid that responds directly to the induced signal current. Output from the transformer is input to an electromagnetic current receiver located remote from the downhole assembly and typically at the surface of the earth. Alternately, voltage resulting from the induced signal current can be measured with a rig voltage receiver and combined with the direct current measurements to enhance signal to noise ratio.

58 Claims, 5 Drawing Sheets

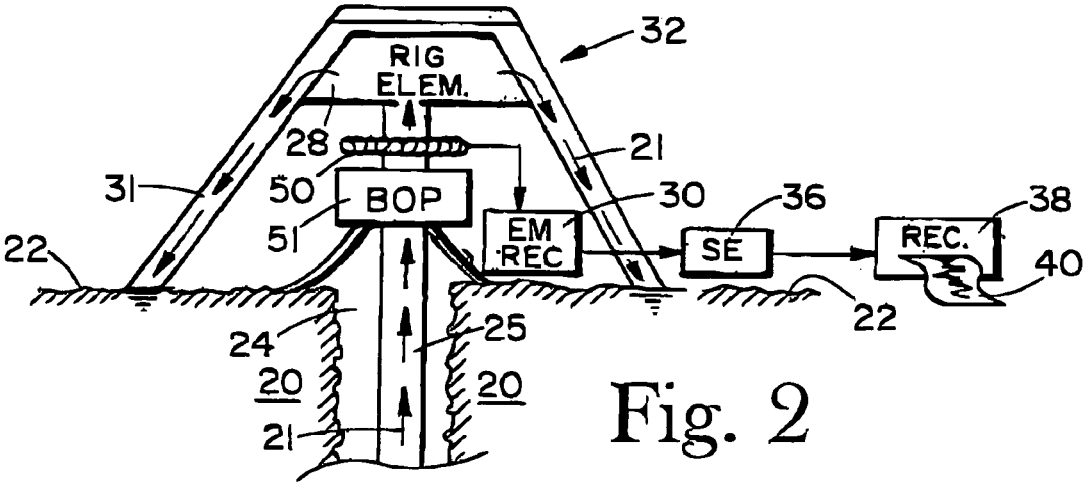
Fig. 2
Fig. 3
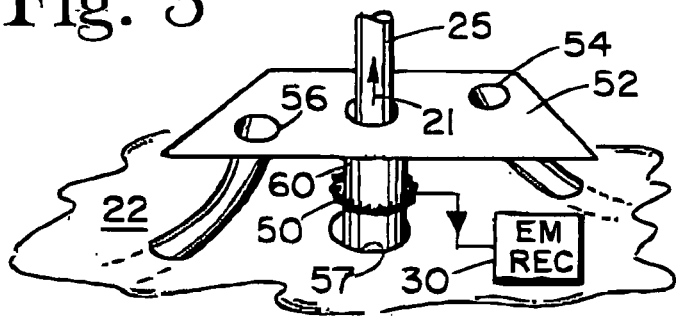
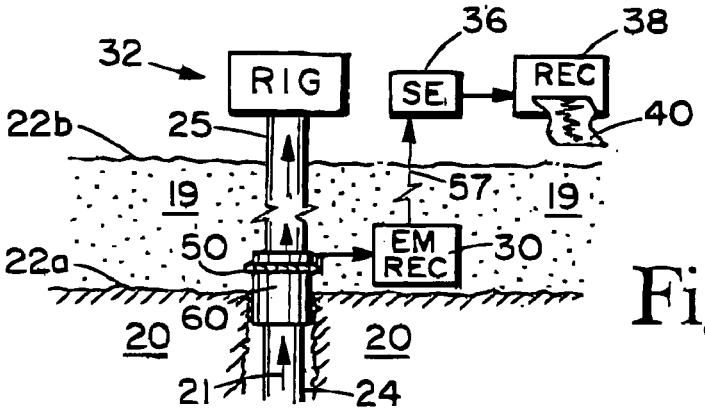
Fig. 4

ELECTROMAGNETIC MWD TELEMETRY SYSTEM INCORPORATING A CURRENT SENSING TRANSFORMER

This invention is directed toward geophysical measurement apparatus and methods employed during the drilling of a well borehole. More specifically, the invention is directed toward an electromagnetic telemetry system for transmitting information from a downhole assembly, which is operationally attached to a drill string, to the surface of the earth. A transmitter induces a current, indicative of the information, within the drill sting. The current is measured with a receiver located remote from the downhole assembly, and the desired information is extracted from the current measurement.

BACKGROUND OF THE INVENTION

Systems for measuring geophysical and other parameters within and in the vicinity of a well borehole typically fall within two categorizes. The first category includes systems that measure parameters after the borehole has been drilled These systems include wireline logging, tubing conveyed long, slick line logging, production logging, permanent downhole sensing devices and other techniques known in the art. The second category includes systems that measure formation and borehole parameters while the borehole is being drilled. These systems include measurements of drilling and borehole specific parameters commonly known as "measurements-while-drilling" (MWD), measurements of parameters of earth formation penetrated by the borehole commonly known as "logging-while-drilling" (LWD), and measurements of seismic related properties known as "seismic-while-drilling" or (SWD).

For brevity, systems that measure parameters of interest while the borehole is being drilled will be referred to collectively in this disclosure as "MWD" systems. Within the scope of this disclosure, it should be understood the MWD systems also include logging-while-drilling an seismic-while-drilling systems.

An MWD system typically comprise a downhole assembly operationally attached to a downhole end of a drill string. The downhole assembly typically includes at least one sensor for measuring at least one parameter of interest, control and power elements for operating the sensor, and a downhole transmitter for transmitting sensor response to the surface of the earth for processing and analysis. Alternately, sensor response data can be stored in the downhole assembly, but these data are not available in "real time" since they can be retrieved only after the downhole assembly has been returned or "tripped' to the surface of the earth. The downhole assembly is terminated at the lower end with a drill bit.

A rotary drilling rig is operationally attached to an upper end of the drill string. The action of the drilling rig rotates the drill string and downhole assembly thereby advancing the borehole by the action of the rotating drill bit. A receiver is positioned remote from the downhole assembly and typically in the immediate vicinity of the drilling rig. The receiver receives telemetered data from the downhole transmitter Received data is typically processed using surface equipment, and one or more parameters of interest are recorded as a function of depth within the well borehole thereby providing a "log" of the one or more parameters.

Several techniques can be used as a basis for the telemetry system. These systems include drilling fluid pressure modulation or "mud pulse" systems, acoustic systems, and electromagnetic systems.

Using a mud pulse system a downhole transmitter induces pressure pulses or other pressure modulations within the drilling fluid used in drilling the borehole. The modulations are indicative of data of interest, such as response of a sensor within the downhole assembly. These modulations are subsequently measured typically at the surface of the earth using a receiver means, and data of interest is extracted from the modulation measurements. Data transmission rates are low using mud pulse systems Furthermore, the signal to noise ratio is typically small and signal attenuation is large, especially for relatively deep boreholes.

A downhole transmitter of an acoustic telemetry induces amplitude and frequency modulated acoustic signals within the drill string. The signals are indicative of data of interest. These modulated signals are measured typically at the surface of the earth by an acoustic receiver means, and data of interest are extracted from the measurements. Once again, data transmission rates are low, the signal to noise ratio of the telemetry system is small, and signal attenuation as a function of depth within lie borehole is large.

Electromagnetic telemetry systems can employ a variety of techniques. Using one technique, electromagnetic signals are modulated to reflect data of interest. These signals are transmitted from a downhole transmitter, through intervening earth formation, and detected using an electromagnetic receiver means that is typically located at the surface of the earth. Data of interest are extracted from the detected signal. Using another electromagnetic technique, a downhole twitter creates a current within the drill string, and the current travels along the drill string. This current is typically created by imposing a voltage across a non-conducting section in the downhole assembly. The current is modulated to reflect data of interest. A voltage generated by the current is measured by a receiver means, which is typically at the surface of the earth. Again, data of interest are extracted from the measured voltage Response properties of electromagnetic telemetry systems will be discussed in subsequent sections of this disclosure.

SUMMARY OF THE INVENTION

The present invention is an electromagnetic telemetry system for transmitting data from a downhole assembly, which is operationally attached to a drill string, to a telemetry receiver system. The data are typically representative of a response of one or more sensors disposed within the downhole assembly. A downhole transmitter creates a signal current within the drill string. The signal current is modulated to represent the transmitted data. Signal current is then measured directly with a telemetry receiver system. The telemetry receiver system includes a transformer that surrounds the path of the current, and a receiver. The transformer preferably comprises a toroid that responds directly to the induced signal current. Output from the transformer is input to the receiver located remote from the downhole assembly and typically at the surface of the earth. Alternately, voltages resulting from the signal current can be measured with a rig voltage receiver and combined with the direct current measurements to enhance signal to noise ratio.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

FIG. 2 is side view of a land based MWD system comprising an electromagnetic telemetry system configured to measure drill string current directly, and to input the current measurement into an electromagnetic current receiver;

FIG. 3 is a perspective view of MWD system comprising an electromagnetic telemetry system configured to measure drill string current directly in the presence of additional boreholes drilled from a common drilling template;

FIG. 4 is side view of a sea based MWD system comprising an electromagnetic telemetry system configured to measure drill string current directly, wherein the toroid transformer and cooperating electromagnetic current receiver are in close proximity to the sea bed and remote from the drilling rig;

DETAILED DESCRIPTION OF THE PREFERRED EMBODIMENTS

Figure 1:
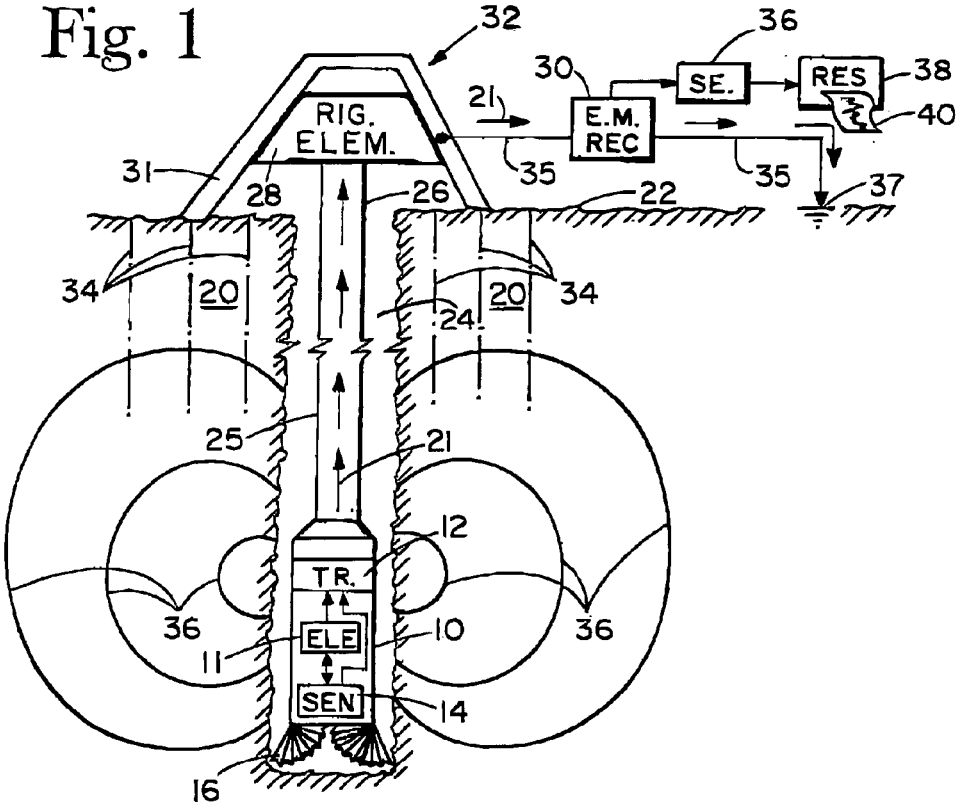
FIG. 1 conceptually illustrates an electromagnetic telemetry system embodied in a MWD system and comprising a downhole transmitter and receiver assembly, wherein a transmitter creates a modulated signal current, within a drill string, indicative of response of at least one sensor in a downhole assembly and the receiver assembly comprises a rig voltage receiver.

FIG. 1 illustrates an electromagnetic (EM) telemetry system embodied in a MWD system. A downhole assembly 10 is shown disposed in a well borehole 24 which penetrates earth formation 20. The upper end of the downhole assembly 10 is operationally attached to a lower end of a drill string 25. The lower end of the borehole assembly is terminated by a drill bit 16. The upper end of the drill string 25 terminates at a rotary drilling rig assembly 32 positioned at the surface 22 of the earth. The rotary drilling rig comprising a derrick 31 and rig elements 28. Elements not shown but included in the rig elements 28 are drilling fluid pumping and circulation equipment, draw works, a motor operated rotary table, a cooperating kelly, and other elements known in rotary drilling. The drilling rig rotates the drill string and attached drill bit 16 thereby advancing the borehole 24.

Still referring to FIG. 1, the downhole assembly comprises an EM transmitter 12 which creates a "signal" current in the drill string 25, as illustrated conceptually by the arrows 21. Hereafter, for purposes of discussion, the signal current will be referred to and identified by the numeral 21. The EM transmitter 12 also generates current within the formation 20, as illustrate by the constant current contours 36. Signal current 21 flowing up the drill string 25 induces voltage within the formation 20, as illustrated conceptually by the broken line constant voltage contours 34. Inputs of an EM receiver 30 are electrically connected to the rig 32 and to a remote ground 37 by means of a conductor 35. The receiver measures a "response signal", which can be a voltage or a current. The EM receiver 30 as configured in FIG. 1 will be referred to as a "rig voltage" receiver. The remote ground 37 can be an iron rod driven in the surface 22 of the earth approximately 100 meters from the rig 32. As shown conceptually in FIG. 1, the EM rig voltage receiver 30 responds to au integral of the electric field between the rig 32 and the remote ground 37. The rig 32 is typically a good conductor, and the electrical potentials are nearly equal on many parts of the rig. For purposes of illustration, the conductor 35 is shown connected to the derrick 31. Alternately, the conductor 35 can be electrically connected to a blow out preventer (BOP) of the type shown in FIG. 2.

Still referring to FIG. 1, the downhole assembly typically comprises at least one sensor 14 that is used to measure a signal which is related to at least one parameter of the formation 20 or the borehole 24. The sensor 14 is preferably controlled and powered by an electronics package 11. The output signal of the sensor 14 is input to the EM transmitter 12. The EM transmitter 12 modulates the current (again represented conceptually by the arrows 21) flowing up the drill string to form a signal current representative of the sensor signal response. The EM transmitter 12 can also be powered and operated by the electronics package 11. Modulation can be analog or digital.

Figure 1A:
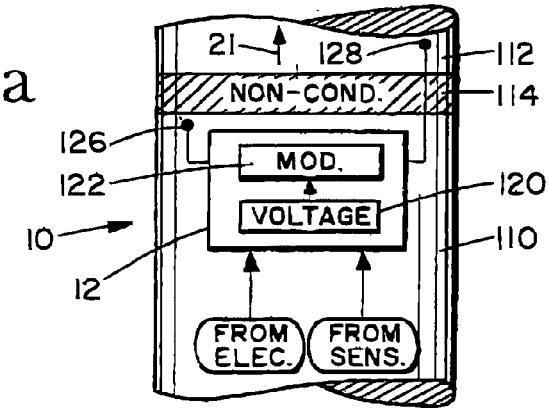
FIG. 1*a* illustrates a downhole transmitter system comprising a non-conducting section, wherein a voltage is imposed across the non-conduction section thereby creating the signal current within the drill string.

FIG. 1*a* illustrates one embodiment of a downhole transmitter system and downhole assembly 10 (see FIG. 1) used to create a modulated signal current 21. The downhole assembly 10 comprises two conducting sections 110 and 112 separated by non-conducting section 114. The downhole transmitter 12 comprises a voltage source 120 and a cooperating modulator 122. Signals from the sensor 14 (see FIG. 1) are input to the transmitter 12, and output from the voltage source 120 is modulated via the modulator 122 to represent response of the sensor 14. Power and control of the voltage source 120 and the modulator 122 are preferably provided by the electronics package 11 (see FIG. 1). Modulated voltage, output from the transmitter 12, is applied at contacts 126 and 128 across the non-conducting material thereby generating the signal current 21, which subsequently travels up the drill string to which the downhole assembly 10 is attached.

While FIG. 1*a* illustrates a downhole transmitter system having a non-conducting section 14, it should be recognized that other embodiments can be employed. For example, the downhole transmitter system could use a system such as that described in U.S. Pat. No. 5,394,141, which is incorporated herein by reference.

The EM rig voltage receiver 30, embodied as shown in FIG. 1, responds to the integral of the electric field between the rig 32 and the remote ground 37, which contains the modulated signal from the sensor 14. The response of the rig voltage EM receiver 30 is demodulated and preferably input to surface equipment 36 where it is converted into the formation or borehole parameter of interest. Output from the surface equipment 36 representative of the parameter of interest is recorded as a function of well depth by a recording means 38 thereby generating a "log" 40 of the parameter. It should be understood that the recording means 38 can be digital or analog, and the log 40 can be in the form of a digital recording, an analog hard copy, and the like.

When the EM telemetry receiver system is embodied to measure rig voltage as shown in FIG. 1, signal to noise ratio of the measurement can be degraded. The conductor 35 can be exposed to changing external magnetic fields, which induces added noise voltage at the input of the EM rig voltage receiver 30. The signal to noise ratio can often be enhance by measuring the signal current directly, as will be set forth in subsequent sections of this disclosure.

FIG. 2 depicts the upper portion of a laud based MWD system comprising an electromagnetic telemetry receiver system configured to directly measure signal current 21 induced in the drill string 25. The bottom or downhole portion of the MWD system is illustrated in FIG. 1. The drill string 25 is again shown suspended in a borehole 24 by a drilling rig 32 comprising a derrick 31, rig elements 28, and a BOP 51. A transformer element 50 of the EM receiver assembly is used to directly measure signal current 21 induced in the drill string 25. The transformer 50 is preferably a toroid that surrounds the signal current path, namely the drill string 25. The toroid is preferably made of laminated high initial permeability 80% nickel steel and turns on the secondary are preferably 10,000 turns. In the embodiment shown in FIG. 2, the toroid 50 is shown surrounding the drill string 25 above the BOP 51. Alternate locations for the transformer toroid can be used. The signal current 21 induces a transformer voltage, which is a response signal containing the modulated sensor signal, within the toroid 50. This induced transformer current is input into an EM receiver 30 where it is demodulated to yield a direct signal current measurement related to the sensor signal. A response signal comprising a response current is also induced within the transformer 50 by the signal current 21. This response signal can alternately be input into the EM receiver 30, where it is demodulated to yield the direct signal current measurement related to the sensor signal. Either of these types of electromagnetic receiver system will be referred to as a "current" receiver. Even though the receiver 30 can respond to either input current or voltage, the receiver system measures the signal "current" 21. The surface equipment 36 and recorder 38 cooperate with the EM current receiver to produce a log 40 of one or more parameters of interest, as discussed in a previous section of this disclosure.

FIG. 3 is a perspective view of a MWD system comprising an electromagnetic telemetry receiver system configured to measure signal current 21 in the drill string 25 of a borehole 57 of an active drilling well in the presence of completed wells 54 and 56 previously drilled from a common drilling template 52. The rig voltage signal from the borehole 57, as defined in the discussion of FIG. 1, is attenuated by a short circuit effect from the template 52 and completed wells 54 and 56. A direct mere of signal current 21 in the drill string 25 in the borehole 57 of the drilling well enhances the signal to noise ratio of the demodulated sensor signal. The drill string 25 typically operates within casing 60, commonly referred to as "surface" casing. A toroid transformer 50 surrounds the casing 60 of the drilling well below the template 52 and above the surface of the earth 22. The signal current 21 induces a transformer current, containing the modulated sensor signal, directly in the toroid transformer 50 before short circuiting effects of the template 52 and completed wells are encounters. This enhances the signal to noise ratio. Output from the toroid transformer is input to the EM current receiver 30 and processes as previously discussed to obtain measures of formation and borehole parameters of interest.

FIG. 4 is an illustration of an offshore MWD system comprising a rig 32 which operates a drill string 25 and cooperating downhole assembly (not shown) that traverses water 19 to advance a borehole 24 through earth formation 20 below the water. The drill string 25 typically operates through a section of casing 60, typically referred to as a "riser". The offshore system is applicable to inland waters as well as sea water. For purposes of discussion, it is assumed that the offshore MWD system is operating in sea water. A signal from a downhole EM transmitter 12 (see FIG. 1) is not only attenuated by earth formation 20, but also by the water 19. Effects of water attenuation can be minimized by disposing the toroid transformer 50 preferably around the casing 60 below the surface 22*b* of the water 19 to measure signal current 21 in close proximity of the sea bed 22*a*. This geometry essentially eliminates attenuation effects of the water 19. Output from the toroid transformer 50 is input to the EM current receiver 30. The EM current receiver 30 can be disposed below the surface 22*b* of the water 19 (as illustrated in FIG. 4), and output from the current receiver transmitted to the surface equipment 36 by means of a "hard wire" communication path 57. Alternately, the EM current receiver 30 can be disposed above (not shown) the water surface 22*b* and output from the toroid transformer 50 can be transmitted to the EM current receiver by means of a hard wire communication path. The hard wire communication path is preferably, but not limited to, an electrical conductor such as a coaxial cable. Output from the EM current receiver 30 is processed as previously discussed to obtain measures of formation and borehole parameters of interest.

Figure 5:
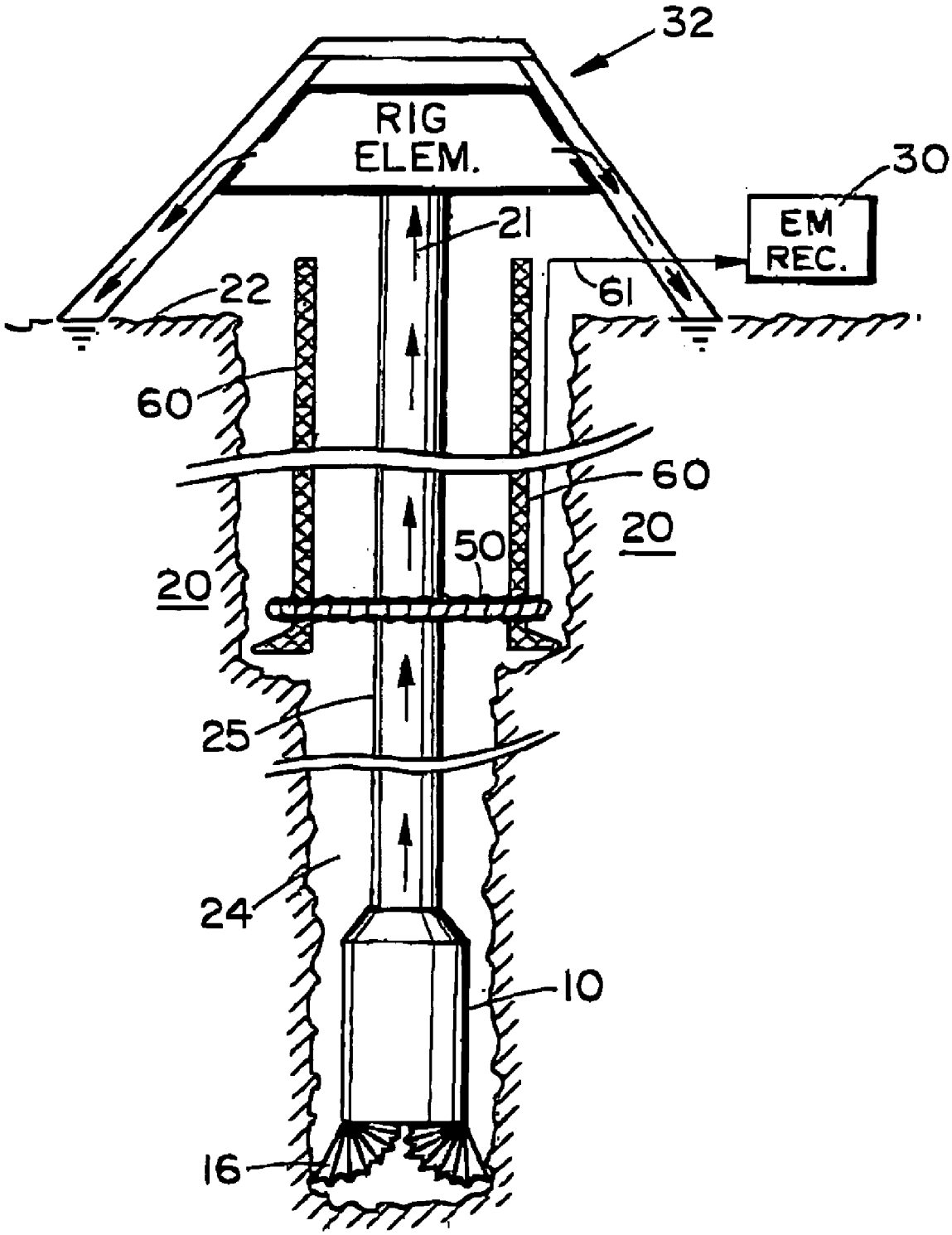
FIG. 5 is side view of a system comprising an electromagnetic telemetry system configured to measure drill string current directly, wherein the toroid transformer is disposed in a casing-borehole annulus and operationally connected to an electromagnetic current receiver are in close proximity to the drilling rig.

FIG. 5 illustrates yet another embodiment of a MWD system comprising an EM telemetry system. A downhole assembly is shown disposed within a borehole 24 by means of a drill string 25. An intermediate sting of casing 60 has been set, and the borehole has been further advanced in the formation 20 by action of the drill bit 16 cooperating with the drilling rig 32. A toroid transformer element 50 of the receiver assembly is shown disposed in the annulus defined by the walls of the borehole 24 and the outside diameter of the casing 60. Operationally, the transformer 50 can be positioned near the bottom of the casing sting 60 before the casing string is run into the borehole 24. The toroid transformer 50 is operationally connected to the EM current receiver 30 located at the surface 22 of the ears and preferably in close proximity to the rig 32, by means of a hard wire communication link 61 such as a coaxial cable. Signal current 21 is measured directly near the bottom of the intermediate casing string 60. Attenuation of signal current from the EM transmitter 12 (see FIG. 1) disposed in the downhole assembly 10 is reduced by the measuring signal current at the bottom of the casing 60 rather than at the surface 22 of the earth. This arrangement effectively reduces the effective current path length thereby enhancing the signal to noise ratio. Alternately, one or more amplifiers and the EM current receiver 30 can be located downhole (not shown) to further enhance signal to noise ratio.

In summary, embodiments illustrated in FIGS. 3, 4 and 5 locate the toroid 50 remote from the rig 32 (or remote from a template 52 through which the rig operates as shown in FIG. 3), to optimize measured response signal with respect to any noise associated with die measurement.

Figure 6:
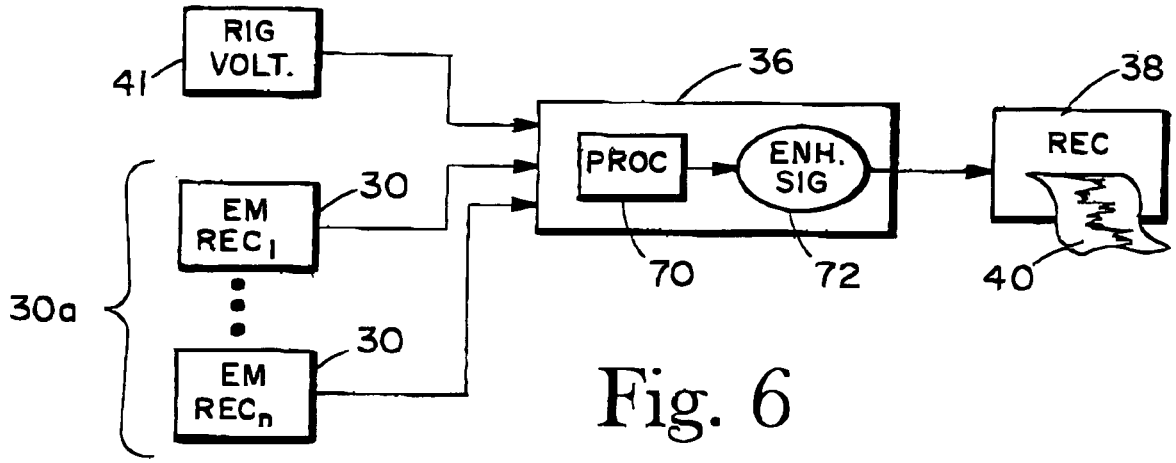
FIG. 6 is a functional diagram of a rig voltage measurement and a drill string current measurement being combined, using a processor, to improve signal to noise ratio of an electromagnetic telemetry system which creates current within a drill string.

Signal to noise ratio can be increased by combining multiple signals of different types that contain components related to a common signal. In the case of the MWD EM telemetry system, both rig voltage measurements and direct current measurements contain a common component, namely a signal component related to the response of a sensor 14 (see FIG. 1) from which a borehole or formation parameter of interest is determined. Noise components of these measurements are different. FIG. 6 is a functional diagram illustrating a rig voltage measurement, from a rig voltage receiver, and one or more direct current measurements 30*a* being combined to obtain a measurement of a parameter of interest with an erased signal to noise ratio. The one or more direct current measurements "n" are designated as EM $REC_i$ (i=1, . . . , n) indicating that these measurements are taken from corresponding EM current receivers 30. Alternately, currents induced in the toroid transformers 50 by the signal current 21 can be used directly. Toroid transformers are disposed at multiple locations along the drill sting, or at multiple locations on the drilling rig 32. Since signal current 21 flows from the drill string 25 through the rig 32 and derrick 32 to ground (as illustrated conceptually in FIG. 5), multiple measurements are obtained of the same signal that have traversed different paths. Signals are input into the surface equipment 36, which preferably contains a processor 70. The multiple signals are combined with the processor 70 yielding an enhanced signal 72 that is input to the recorder 38 to generate the desired log 40 of the parameter of interest.

Figure 7:
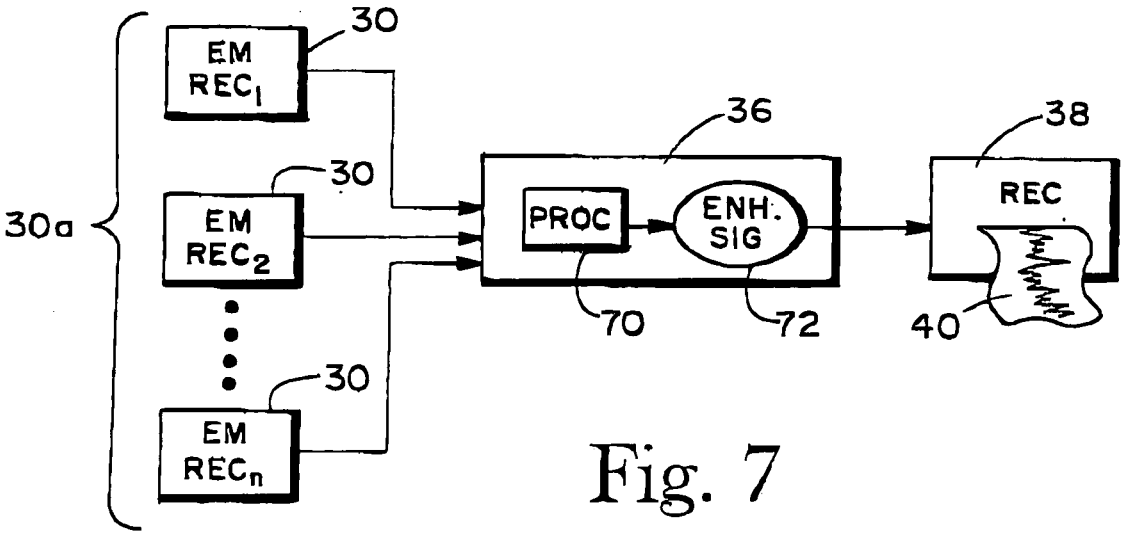
FIG. 7 is a functional diagram of a plurality of drill string current measurements being combined, using a processor means, to improve signal to noise ratio of an electromagnetic telemetry system which creates current within a drill string.

As mentioned above, signal to noise ratio can be enhanced by combining multiple receptions of the same signal that have traversed different paths. FIG. 7 is a fictional diagram illustrating the use of a plurality "n" of direct current measurements 30*a* being combined to obtain a measurement of a parameter of interest with enhanced signal to noise ratio. Again, the direct current measurements are designated as EM.$REC_i$ (i=1, . . . ,n) indicating that these measurements are taken from corresponding EM current receivers 30. Alternately, currents induced in the toroid transformers 50 by the signal current 21 can be used directly. Again, toroid transformers are disposed at multiple locations along the drill string, at multiple locations on the drilling rig 32, or at a combination of these locations yielding multiple receptions of the same type of signal that have traversed different paths. Once again, signals are input into the surface equipment 36, which preferably contains the processor 70. These multiple signals are combined using the processor 70 yielding an enhanced signal 72 which is input to the recorder 38 to generate the desired log 40.

Figure 8A:
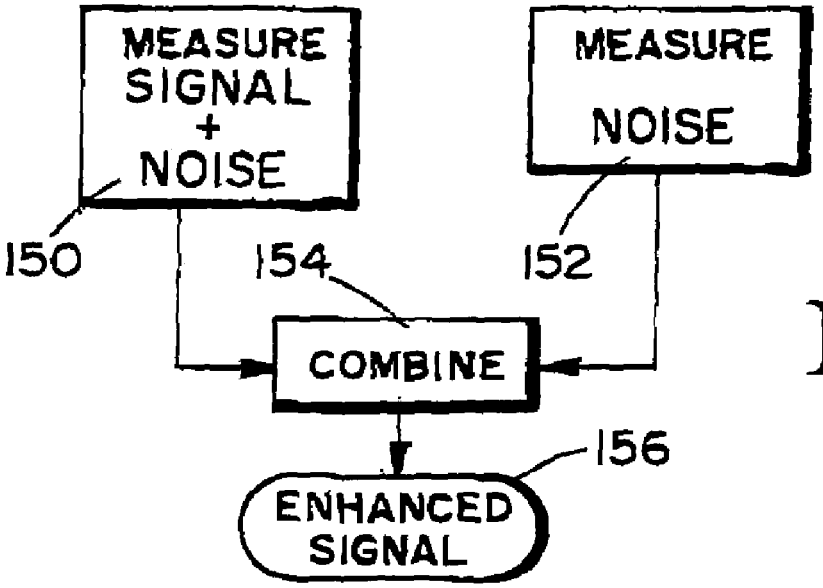
FIG. 8*a* illustrates a method for combining a noise measurement with a signal measurement to obtain an enhanced measure of signal.

Noise sources can be measured uniquely and directly using previously discussed voltage and current measurement techniques. An example of such noise would be pump stroke related noise generated in drilling rig operation FIG. 8*a* illustrates one application of a noise measurement. With the sensor 14 inactive or "OFF", current 21 resulting only from noise is measured at 152. With the sensor 14 active or "ON", current resulting from sensor signal plus noise is measured at 150. The noise measurement 152 and the signal plus noise measurement 150 are combined at 154 to obtain an enhance signal at 156. Combination may simply comprise normalization and determining the difference in signal and signal plus noise measurements to obtain the enhanced signal measurement 156. Alternately, correlation or fitting techniques can be used in combining the signal and signal plus noise measurements to obtain the enhanced signal measurement 156.

Figure 8B:
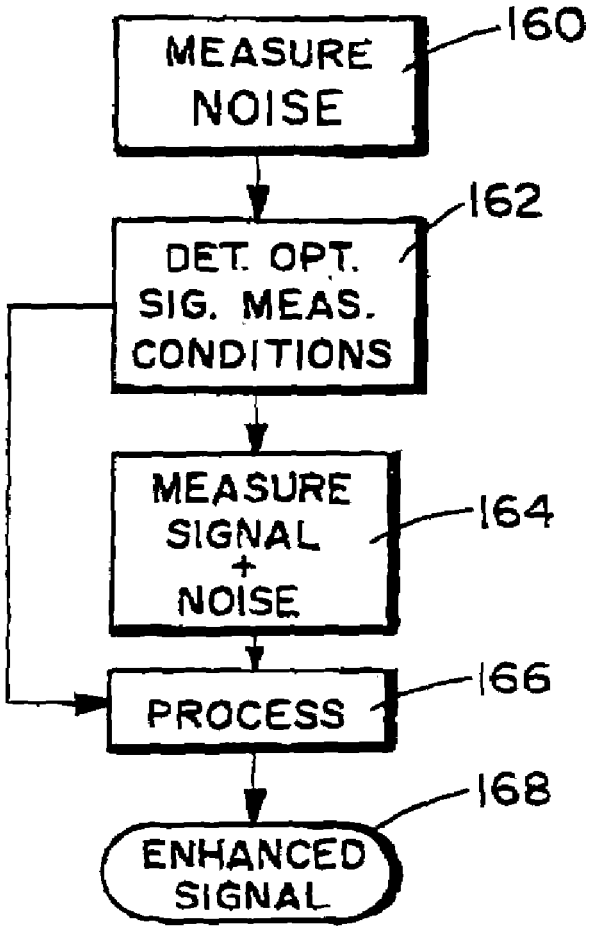
FIG. 8*b* illustrates a method for analyzing a noise measurement and combining this analysis with a signal plus noise measurement to obtain an enhanced measure of signal.

Noise measurements can also be used to select optimum signal transmission frequencies to minimize effects of the noise, or to determine optimum means for combining previously discussed multiple signal plus noise measurements to minimize noise effects (see FIGS. 6 and 7 and related discussion). This is illustrated in the form of a flow chart in FIG. 8*b*. Noise is measured with the sensor OFF at 160. The noise signal is analyzed at 162 to determine optimum conditions (such as optimum frequencies) for measurement of the current 21 when the sensor is ON. Signal current 21 containing both signal (sensor ON) and noise is measured at 164. Noise and signal plus noise measurements from a plurality of receiver systems can be used. The signal plus noise current measurement is processed at 166 using noise analysis information obtained at 162. Output from the processing is an enhanced sign measurement at 168.

While the foregoing disclosure is directed toward the preferred embodiments of the invention, the scope of the invention is defined by the claims, which follow.

What is claimed is:

1. A telemetry receiver system for detecting a signal, said telemetry receiver system comprising:

(a) a transformer which measures a modulated signal current created in a drill pipe; and (b) a current receiver cooperating with said transformer (i) to measure a response signal induced in said transformer by said modulated signal current, and (ii) to demodulate said response signal to obtain said signal.

2. The telemetry receiver system of claim 1 wherein said transformer comprises a toroid transformer surrounding said drill pipe.

3. A telemetry receiver system for detecting a signal, said telemetry receiver system comprising:

(a) a plurality of transformers each of which measures a modulated signal current created in a drill string; and (b) a current receiver cooperating with each of said plurality of transformers (i) to measure a response signals induced in each said transformer by said modulated signal current, and (ii) to demodulate said response signals to obtain said signal; wherein;

(c) at least one of said plurality of transformers comprises a toroid transformer surrounding said drill string;

(d) at least one said plurality of transformers comprises a toroid transformer disposed on a rig operating said drill string; and (e) outputs from said plurality of transformers are combined to yield said signal with an enhanced signal to noise ratio.

4. The telemetry receiver system of claim 1 further comprising an rig voltage receiver, wherein:

(a) said rig voltage receiver measures a modulated voltage signal resulting from said modulated signal current; and (b) output of said rig voltage receiver and said current receiver are combined to yield said signal with an enhanced signal to noise ratio.

5. The telemetry receiver system of claim 1 wherein:

(a) said transformer is disposed in an annulus defined by a wall of a borehole and an outside diameter of casing;

(b) said current receiver is disposed at the surface of the earth; and (c) said transformer and said receiver are operationally connected by means of a communication link.

6. The telemetry receiver system of claim 1 wherein said transformer is disposed underwater at a location where said drill pipe enters a borehole.

7. The telemetry receiver system of claim 1 wherein said transformer is disposed around casing encompassing a drill pipe operating through a template, wherein said template incorporates at least one completed well.

8. The telemetry receiver system of claim 1 wherein said response signal is a voltage.

9. The telemetry receiver system of claim 1 wherein said response signal is a current.

10. A measurement-while-drilling telemetry system comprising:

(a) a transmitter disposed within a downhole assembly, wherein said transmitter cooperates with a sensor to create a modulated signal current in a drill string; and (b) a telemetry receiver system comprising (i) a transformer which measures said modulated signal current, and (ii) a current receiver cooperating with said transformer to measure a response signal induced in said transformer by said signal current, and to demodulate said response signal to yield a signal from said transmitter.

11. The telemetry system of claim 10 wherein said transformer comprises a toroid transformer surrounding said drill string.

12. A measurement-while-drilling telemetry system comprising:

(a) a transmitter disposed within a downhole assembly, wherein said transmitter creates a modulated signal current in a drill string; and (b) a telemetry receiver system comprising (i) a plurality of transformers each of which measures said modulated signal current, and (ii) a current receiver cooperating with said each said transformer to measure a response signal induced in each said transformer by said signal current, and to demodulate said response signal to yield a signal from each said transformer; wherein (c) at least one of said plurality of transformers comprises a toroid transformer surrounding said drill string;

(d) at least one said plurality of transformers comprises a toroid transformer disposed on a rig operating said drill string; and (e) outputs from said plurality of transformers are combined to yield said signal with an enhanced signal to noise ratio.

13. The telemetry system of claim 10 further comprising a rig voltage receiver, wherein:

(a) said rig voltage receiver measures a modulated voltage signal resulting from said modulated signal current; and (b) output of said rig voltage receiver and said current receiver are combined to yield said signal with an enhanced signal to noise ratio.

14. The telemetry system of claim 10 wherein said response signal is a voltage.

15. The telemetry system of claim 10 wherein said response signal is a current.

16. A MWD system comprising:

(a) a downhole assembly which terminates a lower end of a drill string, wherein said downhole assembly comprises (i) a sensor, and (ii) a transmitter, wherein said transmitter is electrically connected to said sensor to create a modulated signal current in said drill string which is indicative of a response of said sensor to a parameter of interest; and (b) a telemetry receiver system comprising (i) a transformer which measures said modulated signal current, and (ii) a current receiver cooperating with said transformer, wherein said current receiver measures a response signal induced in said transformer by said signal current, and demodulates said response signal to yield said response of said sensor.

17. The MWD system of claim 16 wherein said transformer comprises a toroid transformer surrounding said drill string.

18. The MWD system of claim 16 further comprising surface equipment for converting said response of said sensor into said parameter of interest.

19. A MWD system comprising:

(a) a downhole assembly which terminates a lower end of a drill string, wherein said downhole assembly comprises (i) a sensor, and (ii) a transmitter, wherein said transmitter creates a modulated signal current in said drill string which is indicative of a response of said sensor to a parameter of interest; and (b) a telemetry receiver system comprising (i) a plurality of transformers each of which measures said modulated signal current, and (ii) a current receiver cooperating with each said transformer, wherein said current receiver measures a response signal induced in each said transformer by said signal current, and demodulates said response signal to yield said response of said sensor; wherein (c) at least one of said plurality of transformers comprises a toroid transformer surrounding said drill string;

(d) at least one said plurality of transformers comprises a toroid transformer disposed on a rig operating said drill string; and (e) outputs from said plurality of transformers are combined with a processor in surface equipment to yield said response of said sensor with an enhanced signal to noise ratio.

20. The MWD system of claim 16 further comprising an rig voltage receiver, wherein:

(a) said rig voltage receiver measures a modulated voltage signal resulting from said modulated signal current; and (b) output of said rig voltage receiver and said current receiver are combined to yield said response of said sensor with an enhanced signal to noise ratio.

21. The MWD system of claim 16 wherein said response signal is a voltage.

22. The MWD system of claim 16 wherein said response signal is a current.

23. A method for receiving a signal produced by an electromagnetic telemetry system, the method comprising:

(a) detecting, with a transformer, a modulated signal current created in a drill pipe by measuring a response signal induced in said transformer by said modulated signal current; and (b) demodulating said response signal with a current receiver cooperating with said transformer thereby receiving said signal.

24. The method of claim 23 wherein said transformer comprises a toroid transformer surrounding said drill string.

25. A method for receiving a signal produced by an electromagnetic telemetry system, the method comprising:

(a) detecting, with a plurality of transformers, a modulated signal current created in a drill string by measuring a response signal induced in each said transformer by said modulated signal current; and (b) demodulating said response signal with a current receiver cooperating with each said transformer thereby receiving said signal, wherein
(i) at least one of said plurality of transformers comprises a toroid transformer surrounding said drill string, and
(ii) at least one said plurality of transformers comprises a toroid transformed disposed on a rig operating said drill string; and
(c) combining outputs from said plurality of transformers to receive said signal with an enhanced signal to noise ratio.

26. The method of claim 23 further comprising the additional steps of:
(a) providing a rig voltage receiver;
(b) with said rig voltage receiver, measuring a modulated voltage resulting from said modulated signal current; and
(c) combining output of said rig voltage receiver and output of said current receiver to receive said signal with an enhanced signal to noise ratio.

27. The method of claim 23 comprising the additional steps of:
(a) disposing said transformer in an annulus defined by a wall of a borehole and an outside diameter of casing;
(b) disposing said current receiver remote from said transformer; and
(c) operationally connecting said transformer and said current receiver by means of a communication link.

28. The method of claim 23 further comprising disposing said transformer underwater at a location where said drill pipe enters a borehole.

29. The method of claim 23 further comprising disposing said transformer on a casing encompassing a drill pipe that is operating through a template, wherein said template incorporates at least one completed well.

30. The method of claim 23 wherein said response signal is a voltage.

31. The method of claim 23 wherein said response signal is a current.

32. A method for telemetering a signal from a downhole assembly to an uphole location while drilling a borehole, the method comprising:
(a) disposing an electromagnetic transmitter within said downhole assembly, wherein said transmitter cooperates with a sensor to create a modulated signal current in a drill string operationally connected to said downhole assembly;
(b) disposing a telemetry receiver system uphole from said downhole assembly, said telemetry receiver system comprising
(i) a transformer which measures said modulated signal current, and
(ii) a current receiver cooperating with said transformer;
(c) with said current receiver, measuring a response signal induced in said transformer by said signal current; and
(d) with said current receiver, demodulating said response signal to yield said signal.

33. The method of claim 32 wherein said transformer comprises a toroid transformer surrounding said drill string.

34. A method for telemetering a signal from a downhole assembly to an uphole location while drilling a borehole, the method comprising:
(a) disposing an electromagnetic transmitter within said downhole assembly, wherein said transmitter creates a modulated signal current in a drill string operationally connected to said downhole assembly;
(b) disposing a telemetry receiver system uphole from said downhole assembly, said telemetry receiver system comprising
(i) a plurality of transformers which measure said modulated signal current, and
(ii) a current receiver cooperating with each said transformer;
(c) with said current receiver, measuring a response signal induced in each said transformer by said signal current; and
(d) with said current receiver, demodulating said response signal to yield said signal, wherein
(i) at least one of said plurality of transformers comprises a toroid transformer surrounding said drill string, and
(ii) at least one said plurality of transformers comprises a toroid transformer disposed on a rig operating said drill string; and
(e) combining outputs from said plurality of transformers to yield said signal with an enhanced signal to noise ratio.

35. The method of claim 32 comprising the additional steps of:
(a) providing said telemetry receiver system with a rig voltage receiver, wherein said rig voltage receiver measures a modulated voltage signal induced by said modulated signal current; and
(b) combining outputs of said rig voltage receiver and said current receiver to yield said signal with an enhanced signal to noise ratio.

36. The method of claim 32 wherein said response signal is a voltage.

37. The method of claim 32 wherein said response signal is a current.

38. A method for measuring a parameter of interest while drilling a borehole, the method comprising:
(a) providing a downhole assembly that terminates a lower end of a drill string, wherein said downhole assembly comprises
(i) a sensor, and
(ii) a transmitter, wherein said transmitter cooperates with said sensor to create a modulated signal current in a said drill string which is indicative of a response of said sensor to said parameter of interest;
(b) providing a telemetry receiver system comprising
(i) a transformer which measures said modulated signal current, and
(ii) a current receiver cooperating with said transformer;
(c) measuring, with said current receiver, a response signal induced in said transformer by said signal current;
(d) demodulating with said current receiver said response signal to yield said response of said sensor; and
(e) transforming said response of said sensor into a measure of said parameter of interest.

39. The method of claim 38 wherein said transformer comprises a toroid transformer surrounding said drill string.

40. The method of claim 38 further comprising the steps of:
(a) providing surface equipment which cooperates with said current receiver; and
(b) converting said response signal into said parameter of interest using said surface equipment.

41. A method for measuring a parameter of interest while drilling a borehole, the method comprising:

(a) providing a downhole assembly that terminates a lower end of a drill string, wherein said downhole assembly comprises (i) a sensor, and (ii) a transmitter, wherein said transmitter creates a modulated signal current in said drill string which is indicative of a response of said sensor to said parameter of interest;

(b) providing a telemetry receiver system comprising (i) a plurality of transformers each which measures said modulated signal current, and (ii) a current receiver cooperating with each said transformer;

(c) measuring, with said current receiver, a response signal induced in each said transformer by said signal current;

(d) demodulating with said current receiver said response signal to yield said response of said sensor; and (e) transforming said response of said sensor into a measure of said parameter of interest; wherein (f) at least one of said plurality of transformers comprises a toroid transformer surrounding said drill string;

(g) at least one said plurality of transformers comprises a toroid transformer disposed on a rig operating said drill string; and (h) outputs from said plurality of transformers are combined with a processor in said surface equipment to yield a measure of said parameter of interest with an enhanced signal to noise ratio.

42. The method of claim 40 further comprising:

(a) providing said telemetry receiver with a rig voltage receiver;

(b) measuring, with said rig voltage receiver, a modulated voltage signal induced by said modulated signal current; and (c) combining outputs of said rig voltage receiver and said current receiver with a processor in said surface equipment to obtain a measure of said parameter of interest with an enhanced signal to noise ratio.

43. The method of claim 38 wherein said response signal is a voltage.

44. The method of claim 38 wherein said response signal is a current.

45. A method for measuring a parameter of interest while drilling a borehole, the method comprising:

(a) providing a downhole assembly that terminates a lower end of a drill string, wherein said downhole assembly comprises (i) a sensor, and (ii) a transmitter, wherein said transmitter creates a modulated signal current in a drill string which is indicative of a response of said sensor to said parameter of interest;

(b) providing a telemetry receiver system comprising (i) a transformer which measures said modulated signal current, and (ii) a receiver cooperating with said transformer;

(c) with said sensor inactive, measuring with said receiver a noise response signal induced in said transformer by said signal current;

(d) with said sensor activated, measuring with said receiver a signal plus noise response signal induced in said transformer by said signal current;

(e) combining said noise response signal with said signal plus noise response signal to obtain said response of said sensor; and (f) transforming said response of said sensor into a measure of said parameter of interest.

46. The method of claim 45 further comprising the additional step of analyzing said noise response signal to determine optimum conditions under which to measure said signal plus noise response signal.

47. The method of claim 45 wherein said noise response signal and said signal plus noise response signal are voltages.

48. The method of claim 45 wherein said noise response signal and said signal plus noise response signal are currents.

49. A telemetry receiver system for detecting a signal, said telemetry receiver system comprising:

(a) a toroid which measures a modulated signal current that flows in a drill string from a sensor cooperating with a transmitter, wherein said toroid surrounds casing encompassing said drill string; and (b) a current receiver cooperating with said toroid (i) to measure a response signal induced in said toroid by said modulated signal current, and (ii) to demodulate said response signal to obtain said signal.

50. The telemetry receiver system of claim 49 wherein:

(a) said toroid is disposed in an annulus defined by a wall of a borehole and an outside diameter of said casing;

(b) said current receiver is disposed at the surface of the earth; and (c) said toroid and said receiver are operationally connected by means of a communication link.

51. The telemetry receiver system of claim 49 wherein said toroid is disposed underwater at a location where said casing enters a borehole.

52. The telemetry receiver system of claim 49 wherein said toroid is disposed around casing encompassing a drill string operating through a template, wherein said template incorporates at least one completed well.

53. A measurement-while-drilling telemetry system comprising:

(a) a transmitter disposed within a downhole assembly operationally attached to a drill string operated by a rig, wherein said transmitter cooperates with a sensor to create a modulated signal current in said drill string; and (b) a telemetry receiver system comprising (i) a toroid which measures said modulated signal current, and (ii) a current receiver cooperating with said toroid to measure a response signal induced in said toroid by said signal current, and to demodulate said response signal to yield a signal from said transmitter; wherein (c) said toroid is located remote from said rig to optimize said signal with respect to noise.

54. A method for receiving a signal produced by a telemetry system, the method comprising:

(a) detecting, with a toroid surrounding casing in which a drill string is disposed, a modulated signal current created in said drill string by a remote transmitter, by measuring a response signal induced in said toroid by said modulated signal current; and (b) demodulating said response signal with a current receiver cooperating with said toroid thereby receiving said signal.

55. The method of claim 54 comprising the additional steps of:

(a) disposing said toroid in an annulus defined by a wall of a borehole and an outside diameter of said casing;

(b) disposing said current receiver at the surface of the earth; and (c) operationally connecting said toroid and said receiver by means of a communication link.

56. The method of claim 54 comprising the additional step of disposing said toroid underwater at a location where said casing enters a borehole.

57. The method of claim 54 comprising the additional step of disposing said toroid around casing encompassing a drill string operating through a template, wherein said template incorporates at least one completed well.

58. A method for telemetering a signal from a downhole assembly to an uphole location while drilling a borehole:

(a) disposing a transmitter within a downhole assembly operationally attached to a drill string operated by a rig, wherein said transmitter cooperates with a sensor to create a modulated signal current in said drill string;

(b) providing a telemetry receiver system comprising (i) a toroid which measures said modulated signal current, and (ii) a current receiver cooperating with said toroid to measure a response signal induced in said toroid by said modulated signal current, and to demodulate said response signal to yield said signal from said transmitter; and (c) locating said toroid remote from said rig to optimize said signal with respect to noise.

* * * * *